US010338485B2

(12) United States Patent
Okada

(10) Patent No.: US 10,338,485 B2
(45) Date of Patent: Jul. 2, 2019

(54) ELECTROPHOTOGRAPHIC PHOTOSENSITIVE MEMBER

(71) Applicant: KYOCERA Document Solutions Inc., Osaka (JP)

(72) Inventor: Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/080,534

(22) PCT Filed: Feb. 10, 2017

(86) PCT No.: PCT/JP2017/004950
§ 371 (c)(1),
(2) Date: Aug. 28, 2018

(87) PCT Pub. No.: WO2017/169174
PCT Pub. Date: Oct. 5, 2017

(65) Prior Publication Data

US 2019/0064684 A1 Feb. 28, 2019

(30) Foreign Application Priority Data

Mar. 29, 2016 (JP) ..... 2016-065976

(51) Int. Cl.
*G03G 5/06* (2006.01)

(52) U.S. Cl.
CPC ..... *G03G 5/0657* (2013.01); *G03G 5/0614* (2013.01); *G03G 5/0629* (2013.01)

(58) Field of Classification Search
CPC ..... G03G 5/0657; G03G 5/0629
See application file for complete search history.

(56) References Cited

U.S. PATENT DOCUMENTS 5,843,607 A * 12/1998 Hu ..... G03G 5/0653 430/58.5
7,291,429 B2 11/2007 Kim et al.
2005/0112482 A1 5/2005 Kim et al.

FOREIGN PATENT DOCUMENTS

JP 2005-154444 A 6/2005

OTHER PUBLICATIONS

Xia, D.; Marszalek, T.; Li, M.; Guo, X.; Baumgarten, M.; Pisula, W.; Mullen, K. "Solution-Processable n-Type Organic Semiconductors Based on Angular-Shaped 2-(12H-Dibenzofluoren-12-ylidene)malononitrilediimide" Org. Lett. 17, 3074-3077. (Year : 2015).*

* cited by examiner

*Primary Examiner* — Christopher D Rodee
(74) *Attorney, Agent, or Firm* — Studebaker & Brackett PC

(57) ABSTRACT

An electrophotographic photosensitive member (1) includes a conductive substrate (2) and a photosensitive layer (3). The photosensitive layer (3) contains a charge generating material and a compound represented by general formula (1) shown below. In general formula (1), $R^1$ and $R^2$ each represent, independently of one another: a C1-20 alkyl group optionally having at least one of a C6-14 aryl group (Continued)

optionally having a substituent and a C2-20 alkoxycarbonyl group; a C6-14 aryl group optionally having a C1-20 alkyl group; a C3-10 cycloalkyl group; or a C1-6 alkoxy group.
(1)
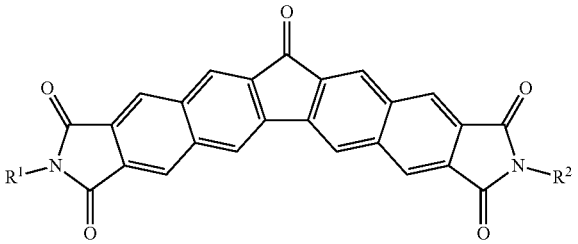
9 Claims, 2 Drawing Sheets

ELECTROPHOTOGRAPHIC PHOTOSENSITIVE MEMBER

TECHNICAL FIELD

The present invention relates to an electrophotographic photosensitive member.

BACKGROUND ART

Electrophotographic photosensitive members are used in electrographic image forming apparatuses. An electrophotographic photosensitive member includes a photosensitive layer. A multi-layer electrophotographic photosensitive member or a single-layer electrophotographic photosensitive member is used as the electrophotographic photosensitive member. The multi-layer electrophotographic photosensitive member includes as a photosensitive layer a charge generating layer having a charge generating function and a charge transport layer having a charge transporting function. The single-layer electrophotographic photosensitive member includes as a photosensitive layer a single-layer photosensitive layer having a charge generating function and a charge transporting function.

An electrophotographic photosensitive member disclosed in Patent Literature 1 includes a photosensitive layer. The photosensitive layer contains for example a compound represented by chemical formula (E-1).

(E-1)

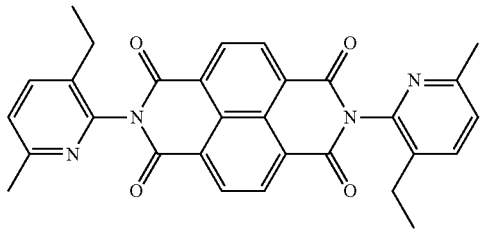

CITATION LIST

Patent Literature

[Patent Literature 1]

Japanese Patent Application Laid-Open Publication No. 2005-154444

SUMMARY OF INVENTION

Technical Problem

However, the electrophotographic photosensitive member disclosed in Patent Literature 1 has unsatisfactory electrical characteristics.

The present invention has been made in view of the foregoing and has its object of providing an electrophotographic photosensitive member excellent in electrical characteristics.

Solution to Problem

An electrophotographic photosensitive member according to the present invention includes a conductive substrate and a photosensitive layer. The photosensitive layer contains a charge generating material and a compound represented by general formula (1) shown below.

(1)

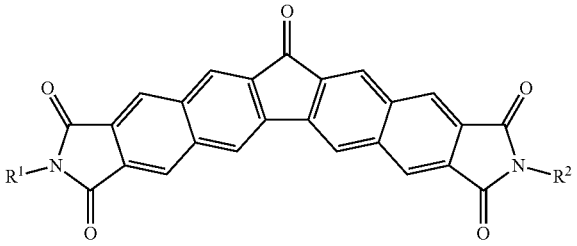

In general formula (1), $R^1$ and $R^2$ each represent, independently of one another: an alkyl group having a carbon number of at least 1 and no greater than 20 and optionally having at least one of an aryl group having a carbon number of at least 6 and no greater than 14 and optionally having a substituent and an alkoxycarbonyl group having a carbon number of at least 2 and no greater than 20; an aryl group having a carbon number of at least 6 and no greater than 14 and optionally having an alkyl group having a carbon number of at least 1 and no greater than 20; a cycloalkyl group having a carbon number of at least 3 and no greater than 10; or an alkoxy group having a carbon number of at least 1 and no greater than 6.

Advantageous Effects of Invention

The electrophotographic photosensitive member according to the present invention is excellent in electrical characteristics.

DESCRIPTION OF EMBODIMENTS

Figure 1A:
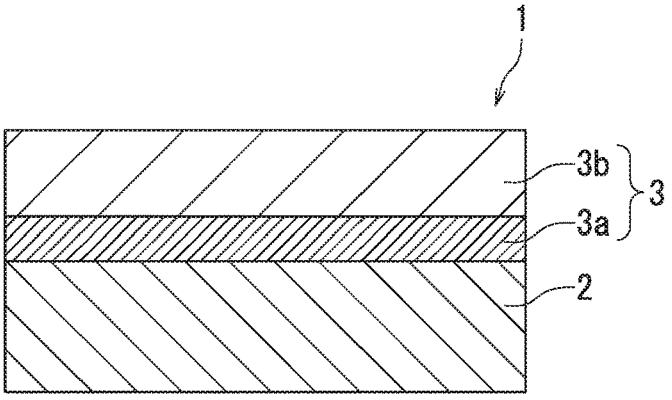
FIG. 1A is a schematic cross-sectional view illustrating an example of an electrophotographic photosensitive member according to an embodiment of the present invention.

An embodiment of the present invention will be described in detail below. The present invention is not limited to the following embodiment at all. Various alterations may be made to practice the present invention within the scope of the objects of the present invention. It should be noted that explanation may be omitted where appropriate in order to avoid repetition, but such omission does not limit the gist of the present invention.

In the following description, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof. In general formulas and chemical formulas, "$CH_3(CH_2)_5$—" represents an n-hexyl group and "$CH_3(CH_2)$—" represents an n-octyl group.

In the following description, a halogen atom, an alkyl group having a carbon number of at least 1 and no greater than 20, an alkyl group having a carbon number of at least 6 and no greater than 20, an alkyl group having a carbon number of at least 1 and no greater than 5, an alkoxy group having a carbon number of at least 1 and no greater than 19, an alkoxy group having a carbon number of at least 1 and no greater than 6, an aryl group having a carbon number of at least 6 and no greater than 14, a cycloalkyl group having a carbon number of at least 3 and no greater than 10, an alkoxycarbonyl group having a carbon number of at least 2 and no greater than 20, and an alkoxycarbonyl group having a carbon number of at least 2 and no greater than 6 indicate the followings unless otherwise stated.

Examples of halogen atoms include a fluorine atom, a chlorine atom, and a bromine atom.

The alkyl group having a carbon number of at least 1 and no greater than 20 as used herein refers to an unsubstituted linear or branched alkyl group. Examples of alkyl groups having a carbon number of at least 1 and no greater than 20 include a methyl group, an ethyl group, an n-propyl group, an isopropyl group, an n-butyl group, an s-butyl group, a tert-butyl group, a pentyl group, an isopentyl group, a neopentyl group, an n-hexyl group, an n-heptyl group, an n-octyl group, a 2-ethylhexyl group, an n-nonyl group, an n-decyl group, an n-undecyl group, an n-dodecyl group, an n-tridecyl group, an n-tetradecyl group, an n-pentadecyl group, an n-hexadecyl group, a 2-hexyldecyl group, an n-heptadecyl group, an n-octadecyl group, an n-nonadecyl group, and an n-icosyl group.

The alkyl group having a carbon number of at least 6 and no greater than 20 as used herein refers to an unsubstituted linear or branched alkyl group. Examples of alkyl groups having a carbon number of at least 6 and no greater than 20 include an n-hexyl group, an n-heptyl group, an n-octyl group, a 2-ethylhexyl group, an n-nonyl group, an n-decyl group, an n-undecyl group, an n-dodecyl group, an n-tridecyl group, an n-tetradecyl group, an n-pentadecyl group, an n-hexadecyl group, a 2-hexyldecyl group, an n-heptadecyl group, an n-octadecyl group, an n-nonadecyl group, and an n-icosyl group.

The alkyl group having a carbon number of at least 1 and no greater than 5 as used herein refers to an unsubstituted linear or branched alkyl group. Examples of alkyl groups having a carbon number of at least 1 and no greater than 5 include a methyl group, an ethyl group, an n-propyl group, an isopropyl group, an n-butyl group, an s-butyl group, a tert-butyl group, a pentyl group, and an isopentyl group.

The alkoxy group having a carbon number of at least 1 and no greater than 19 as used herein refers to an unsubstituted linear or branched alkoxy group. Examples of alkoxy groups having a carbon number of at least 1 and no greater than 19 include a methoxy group, an ethoxy group, an n-propoxy group, an isopropoxy group, an n-butoxy group, an s-butoxy group, a tert-butoxy group, a pentyloxy group, an isopentyloxy group, a neopentyloxy group, a hexyloxy group, a heptyloxy group, an octyloxy group, a nonyloxy group, a decyloxy group, an undecyloxy group, a dodecyloxy group, a tridecyloxy group, a tetradecyloxy group, a pentadecyloxy group, a hexadecyloxy group, a heptadecyloxy group, an octadecyloxy group, and a nonadecyloxy group.

The alkoxy group having a carbon number of at least 1 and no greater than 6 as used herein refers to an unsubstituted linear or branched alkoxy group. Examples of alkoxy groups having a carbon number of at least 1 and no greater than 6 include a methoxy group, an ethoxy group, an n-propoxy group, an isopropoxy group, an n-butoxy group, an s-butoxy group, a tert-butoxy group, a pentyloxy group, an isopentyloxy group, a neopentyloxy group, and a hexyloxy group.

The aryl group having a carbon number of at least 6 and no greater than 14 as used herein refers to an unsubstituted aryl group. Examples of aryl groups having a carbon number of at least 6 and no greater than 14 include unsubstituted monocyclic aromatic hydrocarbon groups having a carbon number of at least 6 and no greater than 14, unsubstituted condensed bicyclic aromatic hydrocarbon groups having a carbon number of at least 6 and no greater than 14, and unsubstituted condensed tricyclic aromatic hydrocarbon groups having a carbon number of at least 6 and no greater than 14. Specific examples of aryl groups having a carbon number of at least 6 and no greater than 14 include a phenyl group, a naphthyl group, an anthryl group, and a phenanthryl group.

The cycloalkyl group having a carbon number of at least 3 and no greater than 10 as used herein refers to an unsubstituted cycloalkyl group. Examples of cycloalkyl groups having a carbon number of at least 3 and no greater than 10 include a cyclopropyl group, a cyclobutyl group, a cyclopentyl group, a cyclohexyl group, a cycloheptyl group, a cyclooctyl group, a cyclononyl group, and a cyclodecyl group.

The alkoxycarbonyl group having a carbon number of at least 2 and no greater than 20 as used herein refers to an unsubstituted linear or branched alkoxycarbonyl group. An alkoxycarbonyl group having a carbon number of at least 2 and no greater than 20 is an ester group resulting from bonding between a carbonyl group and an alkoxy group having a carbon number of at least 1 and no greater than 19. Examples of alkoxycarbonyl groups having a carbon number of at least 2 and no greater than 20 include a methoxycarbonyl group, an ethoxycarbonyl group, a propoxycarbonyl group, a butoxycarbonyl group, a pentyloxycarbonyl group, a hexyloxycarbonyl group, a heptyloxycarbonyl group, an octyloxycarbonyl group, a nonyloxycarbonyl group, a decyloxycarbonyl group, an undecyloxycarbonyl group, a dodecyloxycarbonyl group, a tridecyloxycarbonyl group, a tetradecyloxycarbonyl group, a pentadecyloxycarbonyl group, a hexadecyloxycarbonyl group, a heptadecyloxycarbonyl group, an octadecyloxycarbonyl group, and a nonadecyloxycarbonyl group.

The alkoxycarbonyl group having a carbon number of at least 2 and no greater than 6 as used herein refers to an unsubstituted linear or branched alkoxycarbonyl group. The alkoxycarbonyl group having a carbon number of at least 2 and no greater than 6 is an ester group resulting from bonding between a carbonyl group and an alkoxy group having a carbon number of at least 1 and no greater than 5. Examples of alkoxycarbonyl groups having a carbon number of at least 2 and no greater than 6 include a methoxycarbonyl group, an ethoxycarbonyl group, a propoxycarbonyl group, a butoxycarbonyl group, and a pentyloxycarbonyl group.

An electrophotographic photosensitive member according to the embodiment of the present invention (also referred to below as a photosensitive member) includes a conductive substrate and a photosensitive layer. The photosensitive layer contains a charge generating material and a compound represented by general formula (1) (also referred to below as a diimide compound (1)).

The photosensitive member according to the present embodiment is excellent in electrical characteristics. The reason therefor is presumed as below. The diimide compound (1) has a planar structure resulting from connection between a dibenzofluorenone moiety and imide moieties. Carrier (electron) acceptability and carrier transportability tend to be excellent because the diimide compound (1) has a comparatively large π conjugated system as described above. The diimide compound (1) has a structure in which $R^1$ and $R^2$ each are connected to one of two imide moieties. The diimide compound (1) accordingly tends to be excellent in solubility in a solvent for photosensitive layer formation and dispersibility in a photosensitive layer. Therefore, the photosensitive member according to the present embodiment is thought to be excellent in electrical characteristics.

<1. Multi-Layer Photosensitive Member>

Figure 1B:
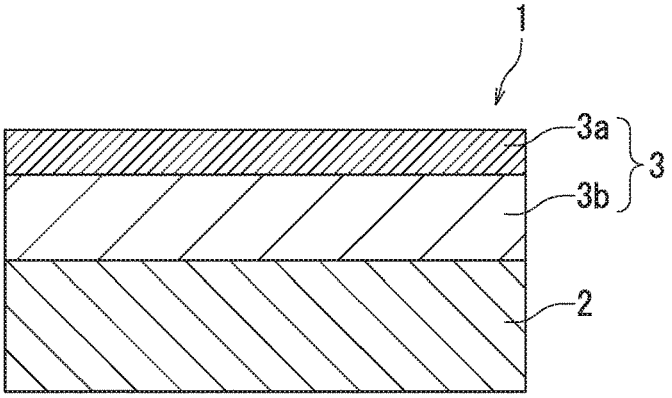
FIG. 1B is a schematic cross-sectional view illustrating an example of the electrophotographic photosensitive member according to an embodiment of the present invention.
Figure 1C:
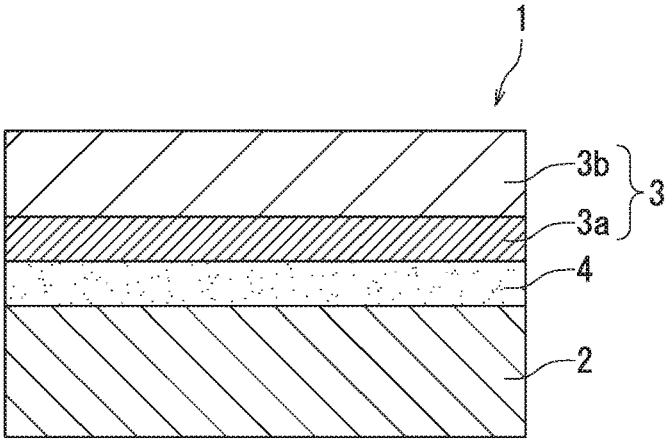
FIG. 1C is a schematic cross-sectional view illustrating an example of the electrophotographic photosensitive member according to an embodiment of the present invention.

The photosensitive member according to the present embodiment may be a multi-layer photosensitive member or a single-layer photosensitive member. The following describes with reference to FIGS. 1A to 1C a configuration of the photosensitive member where the photosensitive member is a multi-layer photosensitive member. FIGS. 1A to 1C are schematic cross-sectional views each illustrating a multi-layer photosensitive member as an example of the photosensitive member according to the embodiment of the present invention.

As illustrated in FIG. 1A, a multi-layer photosensitive member that is a photosensitive member 1 includes a conductive substrate 2 and a photosensitive layer 3. The photosensitive layer 3 includes a charge generating layer 3*a* and a charge transport layer 3*b*. In order to improve abrasion resistance of the multi-layer photosensitive member, it is preferable that the charge generating layer 3*a* is disposed on the conductive substrate 2 and the charge transport layer 3*b* is disposed on the charge generating layer 3*a*, as illustrated in FIG. 1A.

Alternatively, the charge transport layer 3*b* may be disposed on the conductive substrate 2 and the charge generating layer 3*a* may be disposed on the charge transport layer 3*b* in a multi-layer photosensitive member that is the photosensitive member 1, as illustrated in FIG. 1B.

As illustrated in FIG. 1C, a multi-layer photosensitive member that is the photosensitive member 1 may include an intermediate layer (undercoat layer) 4 in addition to the conductive substrate 2 and the photosensitive layer 3. The intermediate layer 4 is disposed between the conductive substrate 2 and the photosensitive layer 3. Additionally, a protective layer 5 (see FIG. 2C) may be disposed on the photosensitive layer 3.

No particular limitations are placed on thicknesses of the charge generating layer 3*a* and the charge transport layer 3*b* so long as the thicknesses thereof are sufficient to enable the layers to implement their respective functions. The thickness of the charge generating layer 3*a* is preferably at least 0.01 μm and no greater than 5 μm, and more preferably at least 0.1 μm and no greater than 3 μm. The thickness of the charge transport layer 3*b* is preferably at least 2 μm and no greater than 100 μm, and more preferably at least 5 μm and no greater than 50 μm.

The charge generating layer 3*a* of the photosensitive layer 3 contains a charge generating material. The charge generating layer 3*a* may contain a charge generating layer binder resin (also referred to below as a base resin). The charge generating layer 3*a* may contain an additive as needed.

The charge transport layer 3*b* contains the diimide compound (1) as an electron acceptor compound. The charge transport layer 3*b* may contain a hole transport material or a binder resin. The charge transport layer 3*b* may contain an additive as needed. Through the above, a configuration of the photosensitive member 1 where the photosensitive member 1 is a multi-layer photosensitive member has been described with reference to FIGS. 1A to 1C.

<2. Single-Layer Photosensitive Member>

Figure 2A:
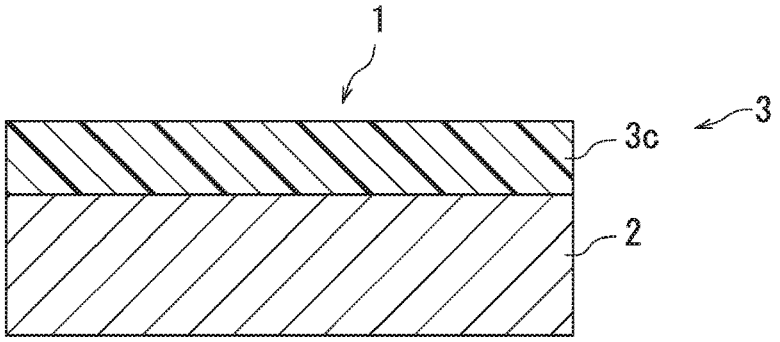
FIG. 2A is a schematic cross-sectional view illustrating another example of the electrophotographic photosensitive member according to an embodiment of the present invention.
Figure 2B:
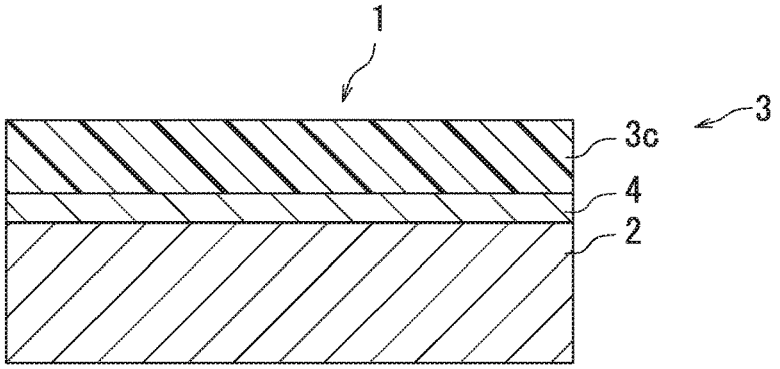
FIG. 2B is a schematic cross-sectional view illustrating another example of the electrophotographic photosensitive member according to an embodiment of the present invention.
Figure 2C:
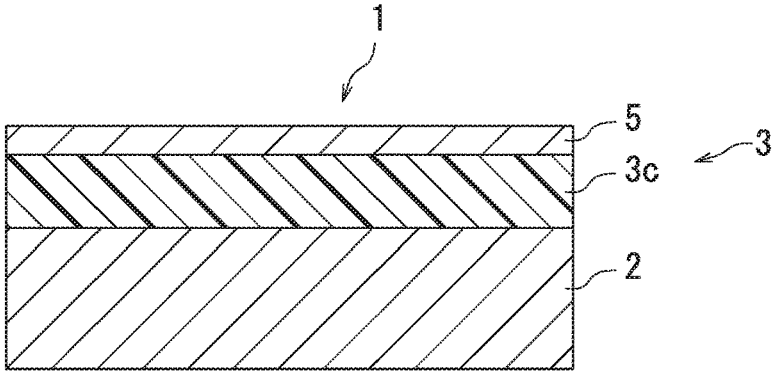
FIG. 2C is a schematic cross-sectional view illustrating another example of the electrophotographic photosensitive member according to an embodiment of the present invention.

The following describes with reference to FIGS. 2A to 2C a configuration of a photosensitive member 1 where the photosensitive member 1 is a single-layer photosensitive member. FIGS. 2A to 2C are schematic cross-sectional views each illustrating a single-layer photosensitive member as another example of the photosensitive member 1 according to the present embodiment.

As illustrated in FIG. 2A, the single-layer photosensitive member that is the photosensitive member 1 includes a conductive substrate 2 and a photosensitive layer 3. The photosensitive layer 3 of the single-layer photosensitive member that is the photosensitive member 1 is a single layer (one layer). In the following description, the photosensitive layer 3 that is a single layer may be referred to as a single-layer photosensitive layer 3*c*.

As illustrated in FIG. 2B, the single-layer photosensitive member that is the photosensitive member 1 may include an intermediate layer (undercoat layer) 4 in addition to the conductive substrate 2 and the single-layer photosensitive layer 3*c*. The intermediate layer 4 is disposed between the conductive substrate 2 and the single-layer photosensitive layer 3*c*. As also illustrated in FIG. 2C, a protective layer 5 may be disposed on the single-layer photosensitive layer 3*c*.

No particular limitations are placed on thickness of the single-layer photosensitive layer 3*c* so long as the thickness thereof is sufficient to enable the single-layer photosensitive layer to implement its function. The thickness of the single-layer photosensitive layer 3*c* is preferably at least 5 μm and no greater than 100 μm, and more preferably at least 10 μm and no greater than 50 μm.

The single-layer photosensitive layer 3*c* that is the photosensitive layer 3 contains a charge generating material and the diimide compound (1) as an electron transport material. The single-layer photosensitive layer 3*c* may further contain at least one of a hole transport material and a binder resin. The single-layer photosensitive layer 3*c* may contain an additive as needed. That is, where the photosensitive member 1 is a single-layer photosensitive member, the photosensitive layer 3 that is a single layer (single-layer photosensitive layer 3*c*) contains a charge generating material, an electron transport material, and a component added as needed (for example, a hole transport material, a binder resin, or an additive). Through the above, a configuration of the photosensitive member 1 where the photosensitive member 1 is a single-layer photosensitive member has been described with reference to FIGS. 2A to 2C.

The following describes elements of the multi-layer photosensitive member and the single-layer photosensitive member.

<3. Conductive Substrate>

No particular limitations are placed on the conductive substrate other than being usable as a conductive substrate of a photosensitive member. It is only required that at least a surface portion of the conductive substrate is formed from a conductive material. An example of the conductive substrate is a conductive substrate formed from a conductive material. Another example of the conductive substrate is a conductive substrate covered with a conductive material. Examples of conductive materials include aluminum, iron, copper, tin, platinum, silver, vanadium, molybdenum, chromium, cadmium, titanium, nickel, palladium, and indium. One of the conductive materials listed above may be used independently, or two or more of the conductive materials listed above may be used in combination. Examples of combinations of the conductive materials include alloys (specific examples include aluminum alloy, stainless steel, and brass). Among the conductive materials listed above, aluminum or aluminum alloy is preferable in terms of favorable mobility of charge from the photosensitive layer to the conductive substrate.

The shape of the conductive substrate is selected as appropriate according to the configuration of an image forming apparatus. Examples of shapes of the conductive substrate include a sheet-like shape and a drum-like shape. The thickness of the conductive substrate is selected as appropriate according to the shape of the conductive substrate.

<4. Diimide Compound>

The photosensitive layer contains the diimide compound (1). Where the photosensitive member is a multi-layer photosensitive member, the charge transport layer contains the diimide compound (1) as an electron acceptor compound. Where the photosensitive member is a single-layer photosensitive member, the single-layer photosensitive layer contains the diimide compound (1) as an electron transport material. Electrical characteristics of the photosensitive member can be improved through the diimide compound (1) being contained in the photosensitive layer. The diimide compound (1) is represented by general formula (1).

(1)

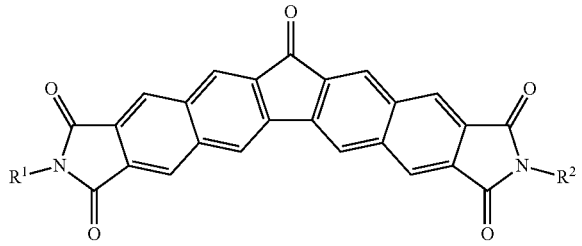

In general formula (1), $R^1$ and $R^2$ each represent, independently of one another: an alkyl group having a carbon number of at least 1 and no greater than 20 and optionally having at least one of an aryl group having a carbon number of at least 6 and no greater than 14 and optionally having a substituent and an alkoxycarbonyl group having a carbon number of at least 2 and no greater than 20; an aryl group having a carbon number of at least 6 and no greater than 14 and optionally having an alkyl group having a carbon number of at least 1 and no greater than 20; a cycloalkyl group having a carbon number of at least 3 and no greater than 10; or an alkoxy group having a carbon number of at least 1 and no greater than 6.

In general formula (1), an alkyl group having a carbon number of at least 1 and no greater than 20 and represented by $R^1$ and $R^2$ may optionally have at least one of an aryl group having a carbon number of at least 6 and no greater than 14 and an alkoxycarbonyl group having a carbon number of at least 2 and no greater than 20. Examples of preferable alkyl groups having a carbon number of at least 1 and no greater than 20 such as above include an alkyl group having a carbon number of at least 6 and no greater than 20 and an alkyl group having a carbon number of at least 1 and no greater than 5 and having at least one of an aryl group having a carbon number of at least 6 and no greater than 14 and optionally having a substituent and an alkoxycarbonyl group having a carbon number of at least 2 and no greater than 20. The alkyl group having a carbon number of at least 1 and no greater than 5 and having an aryl group having a carbon number of at least 6 and no greater than 14 and optionally having a substituent is preferably an alkyl group having a carbon number of at least 1 and no greater than 5 and having a phenyl group optionally having an alkyl group having a carbon number of at least 1 and no greater than 5, more preferably an alkyl group having a carbon number of at least 1 and no greater than 5 and having a phenyl group having an alkyl group having a carbon number of at least 1 and no greater than 5, and further preferably a methylbenzil group. The alkyl group having a carbon number of at least 1 and no greater than 5 and having an alkoxycarbonyl group having a carbon number of at least 2 and no greater than 20 is for example an alkyl group having a carbon number of at least 1 and no greater than 5 and having an alkoxycarbonyl group having a carbon number of at least 2 and no greater than 6, and preferably a 1-ethoxycarbonyl-3-methylbutyl group or a 1,3-diethoxycarbonylproply group. An example of alkyl groups having a carbon number of at least 6 and no greater than 20 is a 2-hexyldecyl group. As described above, when each of substituents (N-substituents) $R^1$ and $R^2$ in the respective diimide moieties is a non-substituted long-chain alkyl group (specific examples include an alkyl group having a carbon number of at least 6 and no greater than 20) or an alkyl group (specific examples include an alkyl group having a carbon number of at least 1 and no greater than 5) having a polar substituent (specific examples include an alkoxycarbonyl group) or an aryl group, solubility of the diimide compound (1) in a solvent for photosensitive layer formation and dispersibility of the diimide compound (1) in a photosensitive layer tend to improve. For the reason as above, the diimide compound (1) having such an alkyl group, which even has a comparatively large π-conjugated system, tends to have excellent solubility in a solvent for photosensitive layer formation and excellent dispersibility in a photosensitive layer. Therefore, when a photosensitive layer contains the diimide compound (1), a photosensitive member is excellent in electrical characteristics and inhibition of crystallization in the photosensitive member can be facilitated.

In general formula (1), it is preferable that $R^1$ and $R^2$ each represent, independently of one another, an alkyl group having a carbon number of at least 6 and no greater than 20 or an alkyl group having a carbon number of at least 1 and no greater than 5 and having at least one of an aryl group having a carbon number of at least 6 and no greater than 14 and having a substituent and an alkoxycarbonyl group having a carbon number of at least 2 and no greater than 6.

The substituent is preferably an alkyl group having a carbon number of at least 1 and no greater than 5, and more preferably a methyl group.

In general formula (1), it is preferable that $R^1$ and $R^2$ each represent, independently of one another; an alkyl group having a carbon number of at least 1 and no greater than 5 and having an aryl group having a carbon number of at least 6 and no greater than 14 and having an alkyl group having a carbon number of at least 1 and no greater than 5; an alkyl group having a carbon number of at least 1 and no greater than 5 and having an alkoxycarbonyl group having a carbon number of at least 2 and no greater than 6; or an alkyl group having a carbon number of at least 6 and no greater than 20. In general formula (1), it is more preferable that $R^1$ and $R^2$ each represent, independently of one another; an alkyl group having a carbon number of at least 1 and no greater than 5 and having a phenyl group (preferably, a methylphenyl group) having an alkyl group having a carbon number of at least 1 and no greater than 5; an alkyl group having a carbon number of at least 1 and no greater than 5 and having an alkoxycarbonyl group having a carbon number of at least 2 and no greater than 6; or an alkyl group having a carbon number of at least 6 and no greater than 20.

$R^1$ and $R^2$ in general formula (1) are preferably the same as each other. Further preferably, $R^1$ and $R^2$ in general formula (1) are the same as each other and each represent an alkyl group having a carbon number of at least 1 and no greater than 5 and having one alkoxycarbonyl group having a carbon number of at least 2 and no greater than 6 or an alkyl group having a carbon number of at least 6 and no greater than 20.

Examples of the diimide compound (1) include compounds represented by chemical formulas (1-1) to (1-4) (also referred to below as diimide compounds (1-1) to (1-4)), respectively.

(1-1)

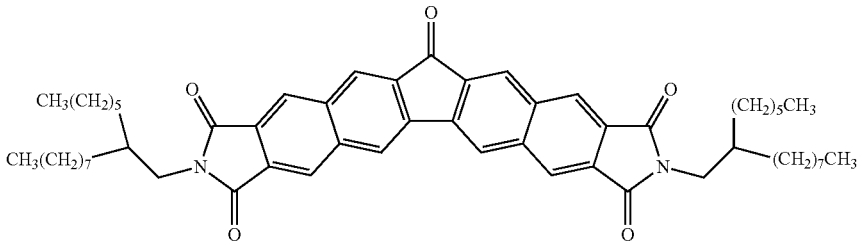

(1-2)

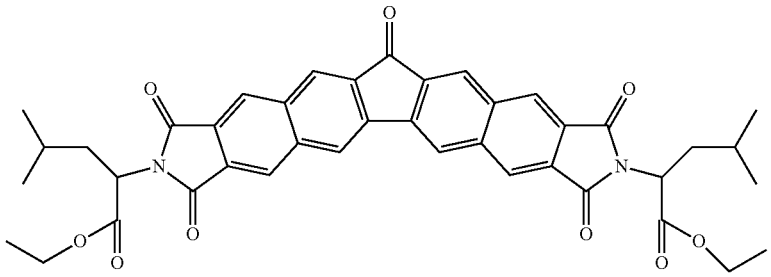

(1-3)

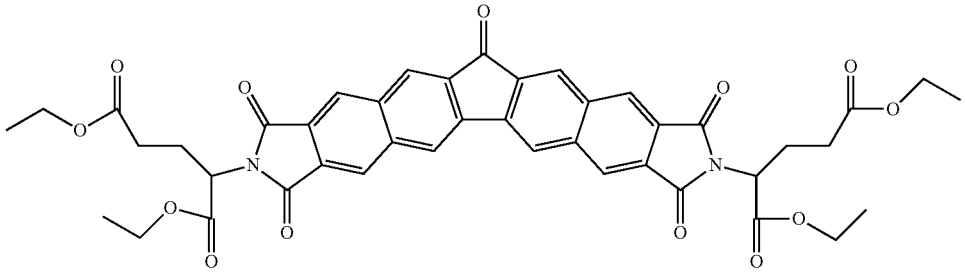

(1-4)

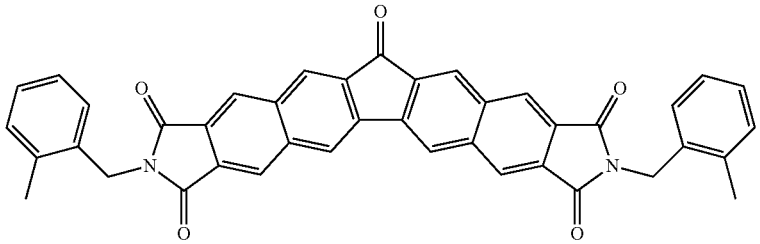

The diimide compound (1) is produced for example according to a reaction represented by reaction formula (R-1) (also referred to below as reaction (R-1)) or a reaction conforming therewith. An appropriate process other than reactions as above may be included as needed.

In reaction (R-1), R is the same as $R^1$ and $R^2$ where $R^1$ and $R^2$ are the same as each other in general formula (1). X represents a halogen atom, and preferably represents a bromine atom.

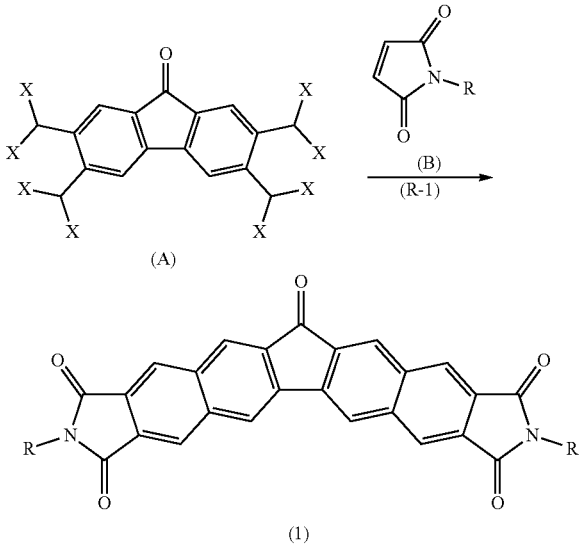

In reaction (R-1), 1 equivalent weight of the diimide compound (1) is obtained through a reaction between 1 equivalent weight of a fluorenone derivative represented by general formula (A) (also referred to below as a fluorenone derivative (A)) and 1 equivalent weight of an N-substituted maleinimide derivative represented by general formula (B) (also referred to below as an N-substituted maleinimide derivative (B)) in the presence of a reductant in a solvent. In reaction (R-1), it is preferable to add at least 1 mole and no greater than 2.5 moles of the N-substituted maleinimide derivative (B) relative to 1 mole of the fluorenone derivative (A). Addition of at least 1 mole of the N-substituted maleinimide derivative (B) relative to 1 mole of the fluorenone derivative (A) can facilitate an increase in percentage yield of the diimide compound (1). By contrast, addition of no greater than 2.5 moles of the N-substituted maleinimide derivative (B) relative to 1 mole of the fluorenone derivative (A) can facilitate purification of the diimide compound (1) since unreacted N-substituted maleinimide derivative (B) hardly remains after the reaction. Reaction (R-1) is preferably carried out at a reaction temperature of at least 50° C. and no greater than 150° C. Reaction (R-1) is preferably carried out for a reaction time of at least 10 hours and no greater than 30 hours. Reaction (R-1) may be carried out in a solvent. Examples of the solvent include dimethyl formamide (DMF), dimethyl sulfoxide (DMSO), and dimethylacetamide. Examples of the reductant include potassium iodide and sodium iodide. Reaction (R-1) preferably proceeds in an atmosphere of an inert gas (for example, argon gas).

Where the photosensitive member is a multi-layer photosensitive member, the amount of the diimide compound (1) is preferably at least 10 parts by mass and no greater than 200 parts by mass relative to 10) parts by mass of the binder resin contained in the charge transport layer, and more preferably at least 20 parts by mass and no greater than 100 parts by mass.

Where the photosensitive member is a single-layer photosensitive member, the amount of the diimide compound (1) is preferably at least 10 parts by mass and no greater than 200 parts by mass relative to 100 parts by mass of the binder resin contained in the single-layer photosensitive layer, more preferably at least 10 parts by mass and no greater than 100 parts by mass, and particularly preferably at least 10 parts by mass and no greater than 75 parts by mass.

Where the charge transport layer contains the diimide compound (1), the charge transport layer may contain another electron acceptor compound in addition to the diimide compound (1). The single-layer photosensitive layer may contain another electron transport material in addition to the diimide compound (1). Examples of the other electron acceptor compound and the other electron transport material include quinone-based compounds, diimide-based compounds (diimide-based compounds other than the diimide compound (1)), hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. One of the electron transport materials listed above may be used independently, or two or more of the electron transport materials listed above may be used in combination.

<5. Hole Transport Material>

Where the photosensitive member is a multi-layer photosensitive member, the charge generating layer may contain a hole transport material. Where the photosensitive member is a single-layer photosensitive member, the single-layer photosensitive layer may contain a hole transport material. Examples of hole transport materials that can be used include nitrogen-containing cyclic compounds and condensed polycyclic compounds. Examples of nitrogen-containing cyclic compounds and condensed polycyclic compounds include diamine derivatives (specific examples include N,N,N',N'-tetraphenylphenylenediamine derivative, N,N,N',N'-tetraphenylnaphtylenediamine derivative, and N,N,N',N'-tetraphenylphenanthrylenediamine derivative), oxadiazole-based compounds (specific examples include 2,5-di(4-methylaminophenyl)-1,3,4-oxadiazole), styryl compounds (specific examples include 9-(4-diethylaminostyryl)anthracene), carbazole compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. One of the hole transport materials listed above may be used independently, or two or more of the hole transport materials listed above may be used in combination. Among the hole transport materials listed above, a compound represented by chemical formula (H-1) (also referred to below as a compound (H-1)) is preferable.

(H-1)

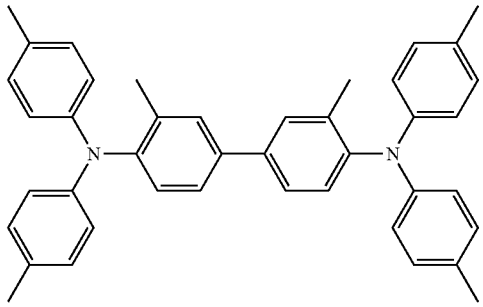

Where the photosensitive member is a multi-layer photosensitive member, the amount of the hole transport material is preferably at least 10 parts by mass and no greater than 200 parts by mass relative to 100 parts by mass of the binder resin contained in the charge transport layer, and more preferably at least 20 parts by mass and no greater than 100 parts by mass.

Where the photosensitive member is a single-layer photosensitive member, the amount of the hole transport material is preferably at least 10 parts by mass and no greater than 200 parts by mass relative to 100 parts by mass of the binder resin contained in the single-layer photosensitive layer, more preferably at least 10 parts by mass and no greater than 100 parts by mass, and particularly preferably at least 10 parts by mass and no greater than 75 parts by mass.

<6. Charge Generating Material>

Where the photosensitive member is a multi-layer photosensitive member, the charge generating layer may contain a charge generating material. Where the photosensitive member is a single-layer photosensitive member, the single-layer photosensitive layer may contain a charge generating material.

No particular limitations are placed on the charge generating material other than being a charge generating material for a photosensitive member. Examples of charge generating materials include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. One of the charge generating materials listed above may be used independently, or two or more of the charge generating materials listed above may be used in combination.

Examples of phthalocyanine-based pigments include metal phthalocyanines and a metal-free phthalocyanine represented by chemical formula (C-1) (also referred to below as a compound (C-1)). Examples of metal phthalocyanines include a titanyl phthalocyanine represented by chemical formula (C-2) (also referred to below as a compound (C-2)), hydroxygallium phthalocyanine, and chlorogallium phthalocyanine. Phthalocyanine-based pigments may be crystalline or non-crystalline. No particular limitations are placed on crystal structure (for example, α-form, β-form, Y-form, V-form, or II-form) of the phthalocyanine-based pigments, and phthalocyanine-based pigments having various crystal structures may be used.

(C-1)

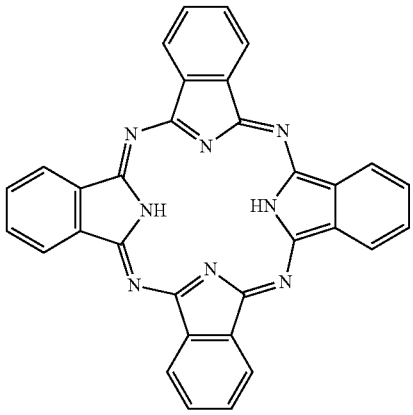

(C-2)

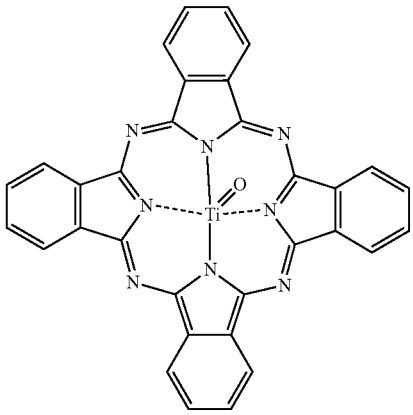

An example of crystalline metal-free phthalocyanines is a metal-free phthalocyanine having an X-form crystal structure (also referred to below as an X-form metal-free phthalocyanine). An example of crystalline titanyl phthalocyanines is a titanyl phthalocyanine having an α-form, β-form, or Y-form crystal structure (also referred to below as an α-form, β-form, or Y-form titanyl phthalocyanine). An example of crystalline hydroxygallium phthalocyanines is a hydroxygallium phthalocyanine having a V-form crystal structure. An example of crystalline chlorogallium phthalocyanines is a chlorogallium phthalocyanine having a II-form crystal structure.

For example, a photosensitive member having sensitivity in a wavelength range of at least 700 nm is preferably used in a digital optical image forming apparatus (for example, a laser beam printer or facsimile machine with a light source such as a semiconductor laser). In terms of having high quantum yield in a wavelength range of at least 700 nm, the charge generating material is preferably a phthalocyanine-based pigment, and more preferably a metal-free phthalocyanine or a titanyl phthalocyanine. Where the photosensitive layer contains the diimide compound (1), a further preferable charge generating material is an X-form metal-free phthalocyanine or a Y-form titanyl phthalocyanine in order to significantly improve electrical characteristics of the photosensitive member.

A Y-form titanyl phthalocyanine has a main peak for example at a Bragg angle (2θ±0.2°) of 27.2° in a CuKα characteristic X-ray diffraction spectrum. The main peak in the CuKα characteristic X-ray diffraction spectrum refers to a peak having a highest or second highest intensity in a range of Bragg angles (2θ±0.2°) from 3° to 40°.

(CuKα Characteristic X-Ray Diffraction Spectrum Measuring Method)

The following describes an example of methods for measuring a CuKα characteristic X-ray diffraction spectrum. A sample (titanyl phthalocyanine) is loaded in a sample holder of an X-ray diffractometer (for example, "RINT (registered Japanese trademark) 1100", product of Rigaku Corporation), and an X-ray diffraction spectrum is measured using a Cu X-ray tube under conditions of a tube voltage of 40 kV, a tube current of 30 mA, and a wavelength of a CuKα characteristic X-ray of 1.542 Å. The measurement range (2θ) is for example from 3° to 40° (starting angle 3°, stop angle 40°). The scanning rate is for example 10°/minute.

An anthanthrone-based pigment is preferably used as a charge generating material in a photosensitive member adopted in an image forming apparatus with a short-wavelength laser light source. The wavelength of the short-wavelength laser light source is for example at least 350 nm and no greater than 550 nm.

Where the photosensitive member is a multi-layer photosensitive member, the amount of the charge generating material is preferably at least 5 parts by mass and no greater than 1,000 parts by mass relative to 100 parts by mass of the base resin contained in the charge generating layer, and more preferably at least 30 parts by mass and no greater than 500 parts by mass.

Where the photosensitive member is a single-layer photosensitive member, the amount of the charge generating material is at least 0.1 parts by mass and no greater than 50 parts by mass relative to 100 parts by mass of the binder resin contained in the single-layer photosensitive layer, more preferably at least 0.5 parts by mass and no greater than 30 parts by mass, and particularly preferably at least 0.5 parts by mass and no greater than 4.5 parts by mass.

<7. Binder Resin>

Where the photosensitive member is a multi-layer photosensitive member, the charge transport layer may contain a binder resin. Where the photosensitive member is a single-layer photosensitive member, the single-layer photosensitive layer may contain a binder resin.

Examples of binder resins include thermoplastic resins, thermosetting resins, and photocurable resins. Examples of thermoplastic resins include polycarbonate resins, polyarylate resins, styrene-butadiene resins, styrene-acrylonitrile resins, styrene-maleic acid resins, acrylic acid-based resins, styrene-acrylic acid-based resins, polyethylene resins, ethylene-vinyl acetate resins, chlorinated polyethylene resins, polyvinyl chloride resins, polypropylene resins, ionomer resins, vinyl chloride-vinyl acetate resins, alkyd resins, polyamide resins, urethane resins, polysulfone resins, diallyl phthalate resins, ketone resins, polyvinyl butyral resins, polyester resins, and polyether resins. Examples of thermosetting resins include silicone resins, epoxy resins, phenolic resins, urea resins, and melamine resins. Examples of photocurable resins include epoxy-acrylic acid-based resins (specific examples include acrylic acid derivative adducts of epoxy compounds), and urethane-acrylic acid-based resins (specific examples include acrylic acid derivative adducts of urethane compounds). One of the binder resins listed above may be used independently, or two or more of the binder resins listed above may be used in combination.

Among the resins listed above, a polycarbonate resin is preferable in terms of enabling a single-layer photosensitive layer and a charge transport layer excellent in balance among workability, mechanical characteristics, optical property, and abrasion resistance to be obtainable. Examples of polycarbonate resins include bisphenol Z polycarbonate resins, bisphenol ZC polycarbonate resins, bisphenol C polycarbonate resins, and bisphenol A polycarbonate resins. An example of bisphenol Z polycarbonate resins is a polycarbonate resin having a repeating unit represented by chemical formula (r-1) shown below (also referred to below as a Z-type polycarbonate resin (r-1)).

(r-1)

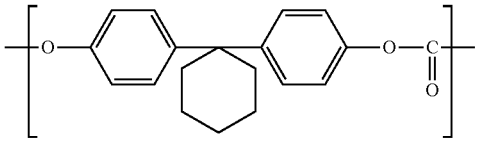

The viscosity average molecular weight of the binder resin is preferably at least 40,000, and more preferably at least 40.000 and no greater than 52,500. When the binder resin has a viscosity average molecular weight of at least 40,000, improvement in abrasion resistance of the photosensitive member can be facilitated. When the binder resin has a viscosity average molecular weight of no greater than 52,500, the binder resin readily dissolves in a solvent in photosensitive layer formation with a result that an application liquid for charge transport layer formation or an application liquid for single-layer photosensitive layer formation is not excessively high in viscosity. Consequently, formation of a charge transport layer or a single-layer photosensitive layer can be facilitated.

<8. Base Resin>

Where the photosensitive member is a multi-layer photosensitive member, the charge generating layer may contain a base resin. No particular limitations are placed on the base resin other than being applicable to a photosensitive member. Examples of base resins include thermoplastic resins, thermosetting resins, and photocurable resins. Examples of thermoplastic resins include styrene-butadiene resins, styrene-acrylonitrile resins, styrene-maleic acid resins, styrene-acrylic acid-based resins, acrylic acid-based resins, polyethylene resins, ethylene-vinyl acetate resins, chlorinated polyethylene resins, polyvinyl chloride resins, polypropylene resins, ionomers, vinyl chloride-vinyl acetate resins, alkyd resins, polyamide resins, urethane resins, polycarbonate resins, polyarylate resins, polysulfone resins, diallyl phthalate resins, ketone resins, polyvinyl butyral resins, polyether resins, and polyester resins. Examples of thermosetting resins include silicone resins, epoxy resins, phenolic resins, urea resins, melamine resins, and other cross-linkable thermosetting resins. Examples of photocurable resins include epoxy-acrylic acid-based resins (specific examples include acrylic acid derivative adducts of epoxy compounds) and urethane-acrylic acid-based resins (specific examples include acrylic acid derivative adducts of urethane compounds). One of the base resins listed above may be used independently, or two or more of the base resins listed above may be used in combination.

The base resin contained in the charge generating layer is preferably different from the binder resin contained in the charge transport layer. This is for the purpose to inhibit the charge generating layer from being dissolved in a solvent of an application liquid for charge transport layer formation. Note that a charge generating layer is formed on a conductive substrate and a charge transport layer is formed on the charge generating layer in typical multi-layer photosensitive member production. This is because an application liquid for charge transport layer formation is applied onto the charge generating layer in formation of the charge transport layer.

<9. Additive>

The photosensitive layer (charge generating layer, charge transport layer, or single-layer photosensitive layer) of the photosensitive member may contain various additives as needed. Examples of additives include antidegradants (for example, antioxidants, radical scavengers, quenchers, and ultraviolet absorbing agents), softeners, surface modifiers, extenders, thickeners, dispersion stabilizers, waxes, donors, surfactants, plasticizers, sensitizers, and leveling agents. Examples of antioxidants include hindered phenols (for example, di(tert-butyl)p-cresol), hindered amine, paraphenylenediamine, arylalkane, hydroquinone, spirochromane, spiroindanone, derivatives of these, organosulfur compounds, and organophosphorus compounds.

<10. Intermediate Layer>

The intermediate layer (undercoat layer) contains for example inorganic particles and a resin (intermediate layer resin) used in an intermediate layer. Provision of the intermediate layer is thought to facilitate flow of current generated when the photosensitive member is exposed to light, while also maintaining insulation to a sufficient degree that current leakage is prevented from occurring, thereby inhibiting increase in resistance Examples of inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the inorganic particles listed above may be used independently, or two or more types of the inorganic particles listed above may be used in combination.

No particular limitations are placed on the intermediate layer resin other than being usable as a resin for intermediate layer formation. The intermediate layer may contain various additives. The additives are the same as those of the photosensitive layer.

<11. Photosensitive Member Production>

Where the photosensitive member is a multi-layer photosensitive member, the multi-layer photosensitive member is produced as follows, for example. First, an application liquid for charge generating layer formation and an application liquid for charge transport layer formation are prepared. The application liquid for charge generating layer formation is applied onto a conductive substrate and dried, thereby forming a charge generating layer. Subsequently, the application liquid for charge transport layer formation is applied onto the charge generating layer and dried, thereby forming a charge transport layer. Through the above, a multi-layer photosensitive member is produced.

The application liquid for charge generating layer formation is prepared by dissolving or dispersing a charge generating material and components to be added as needed (for example, a base resin and various additives) in a solvent. The application liquid for charge transport layer formation is prepared by dissolving or dispersing the diimide compound (1) as an electron acceptor compound and components to be added as needed (for example, a binder resin, a hole transport material, and various additives) in a solvent.

Where the photosensitive member is a single-layer photosensitive member, the single-layer photosensitive member is produced as follows, for example. An application liquid for single-layer photosensitive layer formation is applied onto a conductive substrate and dried, thereby forming a single-layer photosensitive member. The application liquid for single-layer photosensitive layer formation is prepared by dissolving or dispersing the diimide compound (1) as an electron transport material and components to be added as needed (for example, a charge generating material, a hole transport material, a binder resin, and various additives) in a solvent.

No particular limitations are placed on the solvents each contained in a corresponding one of the application liquid for charge generating layer formation, the application liquid for charge transport layer formation, and the application liquid for single-layer photosensitive layer formation (also referred to below each as an application liquid) so long as they can dissolve or disperse components contained in the respective application liquids. Examples of the solvents include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, diethylene glycol dimethyl ether, and propylene glycol monomethyl ether), ketones (for example, acetone, methyl ethyl ketone, and cyclohexanone), esters (for example, ethyl acetate and methyl acetate), dimethyl formaldehyde, dimethyl formamide, and dimethyl sulfoxide. One of the solvents listed above may be used independently, or two or more of the solvents listed above may be used in combination. In order to improve workability in photosensitive member production, a non-halogen solvent (solvent other than halogenated hydrocarbon) is preferably used as the solvents.

Each of the application liquids is prepared by mixing corresponding components and dispersing them in a solvent. For example, a bead mill, a roll mill, a ball mill, an attritor, a paint shaker, or an ultrasonic disperser can be used for mixing and dispersion.

The application liquid may contain for example a surfactant in order to improve dispersibility of the respective components.

No particular limitations are placed on an application liquid applying method other than a method by which uniform application of the application liquid onto a conductive substrate is achievable Examples of application methods include dip coating, spray coating, spin coating, and bar coating.

No particular limitations are placed on an application liquid drying method other than being capable of evaporating the solvent in the application liquid. For example, thermal treatment (hot-air drying) using a high-temperature dryer or a reduced-pressure dryer can be applicable. The thermal treatment may be performed for example at a temperature of at least 40° C. and no greater than 150° C. for at least 3 minutes and no greater than 120 minutes.

Note that the photosensitive member production method may include either or both intermediate layer formation and protective layer formation as needed. Known methods are selected as appropriate for intermediate layer formation and protective layer formation.

The photosensitive member according to the present embodiment has been described so far. The photosensitive member according to the present embodiment is excellent in electrical characteristics.

EXAMPLES

The following describes the present invention further in detail using examples. However, the present invention is in no way limited to the scope of the examples.

<1. Materials of Photosensitive Member>

The following electron transport materials, hole transport material, charge generating materials, and binder resin were prepared as materials for forming single-layer photosensitive layers of single-layer photosensitive members.

<1-1. Electron Transport Material>

The diimide compounds (1-1) to (1-4) were produced each as an electron transport material by the following respective methods.

<1-1-1. Production of Diimide Compound (1-1)>

The diimide compound (1-1) was produced according to reaction (R-2).

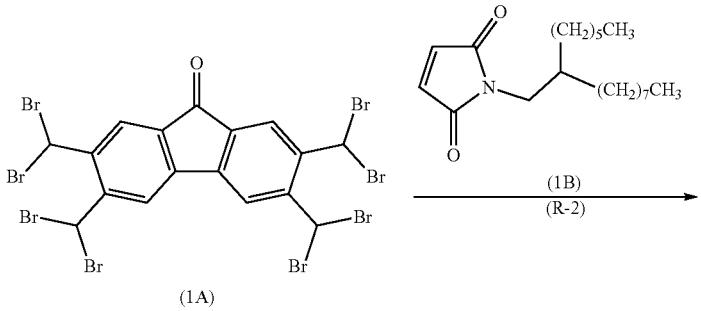

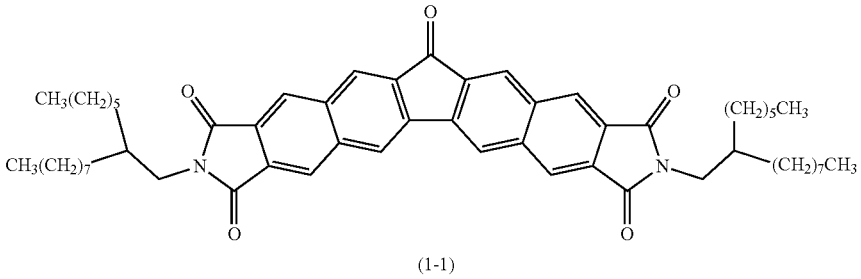

In reaction (R-2), a fluorenone derivative (1A) and an N-substituted maleinimide derivative (1B) were caused to react together to obtain the diimide compound (1-1). Specifically, a 200-mL flask was charged with 0.87 g (1.0 millimole) of the fluorenone derivative (1A), 0.80 g (2.5 millimoles) of the N-substituted maleinimide derivative (1B), 1.5 g (10 millimoles) of sodium iodide, and 20 mL of dried dimethylacetamide. Gas in the flask was replaced with argon gas. The flask contents were stirred for 20 hours at a temperature of 80° C. and then cooled to room temperature. Ion exchanged water was added to the flask contents, and an organic layer was extracted. The organic layer was evaporated under reduced pressure to give a residue. The resultant residue was purified by silica gel chromatography using chloroform as a developing solvent. Through the above, the diimide compound (1-1) was obtained. A mass yield of the diimide compound (1-1) was 0.52 g (percentage yield: 60% by mole).

<1-1-2 Production of Diimide Compounds (1-2) to (1-4)>

The diimide compounds (1-2) to (1-4) were produced according to the same production method as for the diimide compound (1-1) in all aspects other than the following changes. Note that materials used in production of the diimide compounds (1-2) to (1-4) were each added in the same number of moles as that of a corresponding one of the materials used in production of the diimide compound (1-1).

Table 1 shows a fluorenone derivative (A), N-substituted maleinimide derivatives (B), and diimide compounds (1) in reaction (R-2). The fluorenone derivative (A) and each N-substituted maleinimide derivative (B) herein are reactants in reaction (R-2). A fluorenone derivative (A) and an N-substituted maleinimide derivative (B) shown in Table 1 were used instead of the fluorenone derivative (1A) and the N-substituted maleinimide derivative (1B) used in reaction (R-2). As a result, the diimide compounds (1-2) to (1-4) were obtained. Table 1 shows mass yield and percentage yield of the diimide compounds (1).

In Table 1, 2B, 3B, and 4B under "Type" of the N-substituted maleinimide derivatives indicate N-substituted maleinimide derivatives (2B), (3B), and (4B), respectively. The N-substituted maleinimide derivatives (2B) to (4B) are represented by the following chemical formulas (2B) to (4B), respectively.

TABLE 1

| Reaction (R-2) | | | | | | | | |
|---|---|---|---|---|---|---|---|---|
| | | | | | | Diimide compound (1) | | |
| Fluorenone derivative (A) | | | N-substituted maleinimide derivative (B) | | | | Mass | Percentage yield |
| Type | Amount [g] | Amount [millimole] | Type | Amount [g] | Amount [millimole] | Type | yield [g] | [% by mole] |
| 1A | 0.87 | 1.0 | 1B | 0.80 | 2.5 | 1-1 | 0.52 | 60 |
| 1A | 0.87 | 1.0 | 2B | 0.60 | 2.5 | 1-2 | 0.39 | 55 |
| 1A | 0.87 | 1.0 | 3B | 0.71 | 2.5 | 1-3 | 0.40 | 50 |
| 1A | 0.87 | 1.0 | 4B | 0.50 | 2.5 | 1-4 | 0.38 | 60 |

(2B)

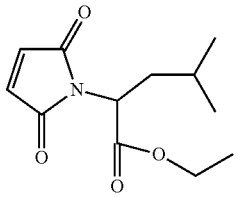

(3B)

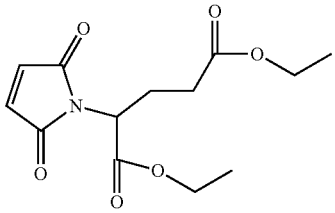

(4B)

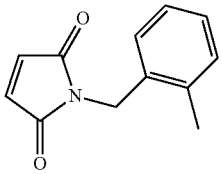

Subsequently, a $^1$H-NMR spectrum of each of the produced diimide compounds (1-1) to (1-4) was measured using a proton nuclear magnetic resonance spectrometer (product of JASCO Corporation, 300 MHz). $CDCl_3$ was used as a solvent. Tetramethylsilane (TMS) was used as an internal standard sample. Among these compounds, the diimide compound (1-1) will be described as a representative example. The following indicates chemical shift values of the diimide compound (1-1). Diimide compound (1-1): $^1$H-NMR (300 MHz, $CDCl_3$): δ=8.45 (s, 2H), 8.37 (s, 4H), 8.36 (s, 2H), 3.60 (d, 4H), 1.81-1.88 (m, 2H), 1.21-1.35 (m, 48H), 0.80-0.84 (m, 12H).

It was confirmed from the $^1$H-NMR spectrum and the chemical shift values that the diimide compound (1-1) was obtained. It was also confirmed likewise from the $^1$H-NMR spectra and the chemical shift values that the diimide compounds (1-2) to (1-4) were obtained.

<1-1-3. Preparation of Compound (E-1)>

A compound represented by chemical formula (E-1) (also referred to below as a compound (E-1)) was prepared as an electron transport material.

(E-1)

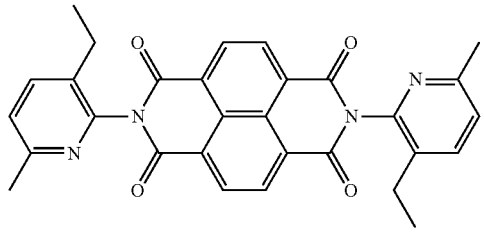

<1-2. Hole Transport Material>

The compound (H-1), which has been already described above, was prepared as a hole transport material.

(H-1)

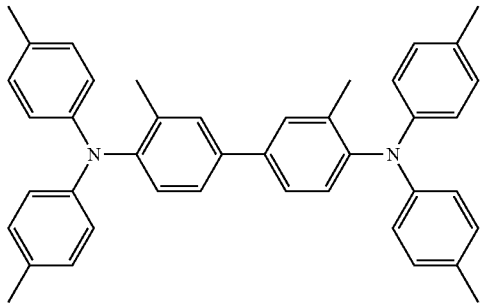

<1-3. Charge Generating Material>

The compounds (C-1) and (C-2), which have been already described above, were prepared each as a charge generating material. The compound (C-1) was a metal-free phthalocyanine (X-form metal-free phthalocyanine) represented by chemical formula (C-1). The crystal structure of the compound (C-1) was an X-form.

The compound (C-2) was a titanyl phthalocyanine (Y-form titanyl phthalocyanine) represented by chemical formula (C-2). The crystal structure of the compound (C-2) was a Y-form.

<1-4. Binder Resin>

The Z-type polycarbonate resin (r-1) ("PANLITE (registered Japanese trademark) TS-2050", product of Teijin Limited, viscosity average molecular weight 50,000), which has been already described above, was prepared as a binder resin.

<2. Production of Single-Layer Photosensitive Members>

Single-layer photosensitive members (A-1) to (A-8), (B-1), and (B-2) were produced with materials for photosensitive layer formation.

<2-1. Production of Single-Layer Photosensitive Member (A-1)>

A vessel was charged with 5 parts by mass of the compound (C-1) as a charge generating material, 80 parts by mass of the compound (H-1) as a hole transport material, 40 parts by mass of the diimide compound (1-1) as an electron transport material, 100 parts by mass of the Z-type polycarbonate resin (r-1) as a binder resin, and 800 parts by mass of tetrahydrofuran as a solvent. The vessel contents were mixed for 50 hours using a ball mill for dispersion of the materials in the solvent. The above gave an application liquid for single-layer photosensitive layer formation. The application liquid for single-layer photosensitive layer formation was applied onto a drum-shaped aluminum support (diameter 30 mm, total length 238.5 mm) as a conductive substrate by dip coating. The applied application liquid for single-layer photosensitive layer formation was hot-air dried at a temperature of 100° C. for 30 minutes. Through the above, a single-layer photosensitive layer (film thickness 30 μm) was formed on the conductive substrate. As a result, a single-layer photosensitive member (A-1) was obtained.

<2-2. Production of Single-Layer Photosensitive Members (A-2) to (A-8), (B-1), and (B-2)>

Single-layer photosensitive members (A-2) to (A-8), (B-1), and (B-2) were produced according to the same method as for the single-layer photosensitive member (A-1) in all aspects other than the following changes. The compound (C-1) as a charge generating material used in production of the single-layer photosensitive member (A-1) was changed to a corresponding one of charge generating materials shown in Table 2. The diimide compound (1-1) as an electron transport material used in production of the single-layer photosensitive member (A-1) was changed to a corresponding one of electron transport materials shown in Table 2. Note that respective compositions of the photosensitive members (A-1) to (A-8), (B-1), and (B-2) are shown in Table 2. CGM, HTM, and ETM in Table 2 indicate a charge generating material, a hole transport material, and an electron transport material, respectively. x-$H_2$Pc and Y-TiOPc in the column under "CGM" in Table 2 represent the compound (C-1, X-form metal-free phthalocyanine) and the compound (C-2, Y-form titanyl phthalocyanine), respectively. H-1 in the column under "HTM" represents the compound (H-1). In the column under "ETM", 1-1 to 1-4 and E-1 represent the diimide compounds (1-1) to (1-4) and the compound (E-1), respectively.

<3. Performance Evaluation for Photosensitive Members>

<3-1. Evaluation of Electrical Characteristics for Single-Layer Photosensitive Members>

Evaluation of electrical characteristics was performed on each of the produced single-layer photosensitive members (A-1) to (A-8) and (B-1) to (B-2). Evaluation of electrical characteristics was carried out in an environment at a temperature of 23° C. and a relative humidity of 60%. First, a surface of the single-layer photosensitive member was charged positively using a drum sensitivity test device (product of Gen-Tech, Inc.). The charging was carried out under set conditions of a rotational speed of the single-layer photosensitive member of 31 rpm and an electric current flowing into the single-layer photosensitive member of +8 μA. A surface potential of the single-layer photosensitive member directly after the charging was set at +700 V. Subsequently, monochromatic light (wavelength 780 nm, half-width 20 nm, optical energy 1.5 μJ/cm$^2$) was taken out from white light of a halogen lamp using a bandpass filter. The surface of the single-layer photosensitive member was irradiated with the taken monochromatic light. A surface potential of the single-layer photosensitive member was measured when 0.5 seconds elapsed from termination of the irradiation. The measured surface potential was taken to be a sensitivity potential ($V_L$, unit: V). Sensitivity potentials ($V_L$) of the single-layer photosensitive members measured as above are shown in Table 2. A smaller absolute value of a sensitivity potential ($V_L$) indicates more excellent electrical characteristics of the single-layer photosensitive member.

TABLE 2

| | Photosensitive member No. | Photosensitive layer CGM | HTM | ETM | Electrical characteristics $V_L$ (V) |
|---|---|---|---|---|---|
| Example 1 | A-1 | x-$H_2$Pc | H-1 | 1-1 | +105 |
| Example 2 | A-2 | Y—TiOPc | H-1 | 1-1 | +101 |
| Example 3 | A-3 | x-$H_2$Pc | H-1 | 1-2 | +106 |
| Example 4 | A-4 | Y—TiOPc | H-1 | 1-2 | +101 |
| Example 5 | A-5 | x-$H_2$Pc | H-1 | 1-3 | +106 |
| Example 6 | A-6 | Y—TiOPc | H-1 | 1-3 | +102 |
| Example 7 | A-7 | x-$H_2$Pc | H-1 | 1-4 | +108 |
| Example 8 | A-8 | Y—TiOPc | H-1 | 1-4 | +103 |
| Comparative Example 1 | B-1 | x-$H_2$Pc | H-1 | E-1 | +135 |
| Comparative Example 2 | B-2 | Y—TiOPc | H-1 | E-1 | +130 |

As shown in Table 2, photosensitive layers of the photosensitive members (A-1) to (A-8) each contained any one of the diimide compounds (1-1) to (1-4) as an electron transport material. The diimide compounds (1-1) to (1-4) each were encompassed in the compound represented by general formula (1). The photosensitive members (A-1) to (A-8) each had a sensitivity potential of at least +101 V and no greater than +108 V.

As shown in Table 2, photosensitive layers of the photosensitive members (B-1) and (B-2) each contained the compound (E-1) as an electron transport material. The compound (E-1) was not encompassed by the compound represented by general formula (1). The photosensitive members (B-1) and (B-2) each had a sensitivity potential of at least +130 V and no greater than +135 V.

It is evident that the photosensitive members (A-1) to (A-8) were more excellent in electrical characteristics than the photosensitive members (B-1) and (B-2).

From the above, it is evident that a photosensitive member including a photosensitive layer containing the diimide compound represented by general formula (1) is excellent in electrical characteristics.

<3-2. Evaluation of Crystallization Inhibition for Photosensitive Members>

Surfaces of the produced single-layer photosensitive members (A-1) to (A-8), (B-1), and (B-2) were observed visually.

No crystallization was observed on the surface of any of the photosensitive members (A-1) to (A-8). By contrast, slight crystallization was observed on the surface of each of the photosensitive members (B-1) and (B-2). From the above, it was shown that crystallization could be inhibited in a photosensitive member including a photosensitive layer containing the diimide compound represented by general formula (1).

INDUSTRIAL APPLICABILITY

The photosensitive member according to the present invention can be used in an image forming apparatus.

The invention claimed is:

1. An electrophotographic photosensitive member comprising a conductive substrate and a photosensitive layer, wherein the photosensitive layer contains a charge generating material and a compound represented by a general formula (1) shown below:

(1)

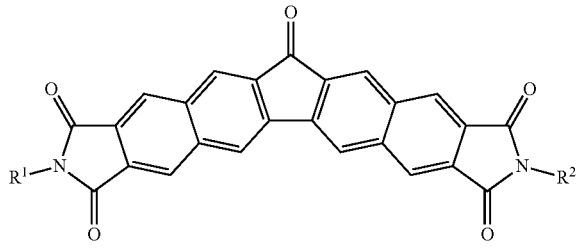

where in the general formula (1), $R^1$ and $R^2$ each represent, independently of one another; an alkyl group having a carbon number of at least 1 and no greater than 20 and optionally having at least one of an aryl group having a carbon number of at least 6 and no greater than 14 and optionally having a substituent and an alkoxycarbonyl group having a carbon number of at least 2 and no greater than 20; an aryl group having a carbon number of at least 6 and no greater than 14 and optionally having an alkyl group having a carbon number of at least 1 and no greater than 20; a cycloalkyl group having a carbon number of at least 3 and no greater than 10; or an alkoxy group having a carbon number of at least 1 and no greater than 6.

2. The electrophotographic photosensitive member according to claim 1, wherein in the general formula (1), $R^1$ and $R^2$ each represent, independently of one another, an alkyl group having a carbon number of at least 6 and no greater than 20 or an alkyl group having a carbon number of at least 1 and no greater than 5 and having at least one of an aryl group having a carbon number of at least 6 and no greater than 14 and having the substituent and an alkoxycarbonyl group having a carbon number of at least 2 and no greater than 6, and the substituent is an alkyl group having a carbon number of at least 1 and no greater than 5.

3. The electrophotographic photosensitive member according to claim 1, wherein in the general formula (1), $R^1$ and $R^2$ are the same as each other.

4. The electrophotographic photosensitive member according to claim 1, wherein in the general formula (1), $R^1$ and $R^2$ are the same as each other and each represent an alkyl group having a carbon number of at least 6 and no greater than 20 or an alkyl group having a carbon number of at least 1 and no greater than 5 and having one alkoxycarbonyl group having a carbon number of at least 2 and no greater than 6.

5. The electrophotographic photosensitive member according to claim 1, wherein the compound represented by the general formula (1) is a compound represented by any of chemical formulas (1-1), (1-2), (1-3), and (1-4) shown below:

(1-1)

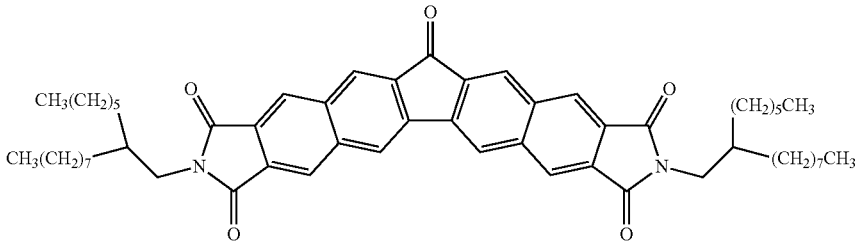

(1-2)

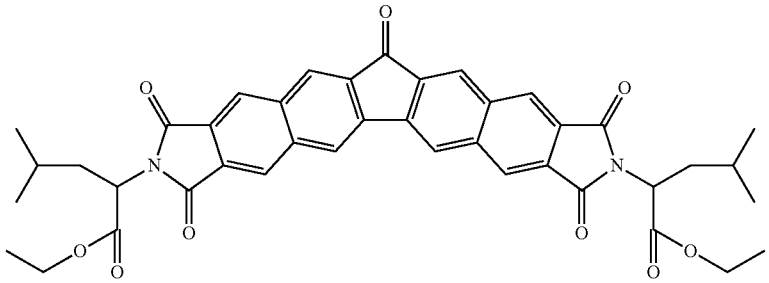

-continued (1-3)

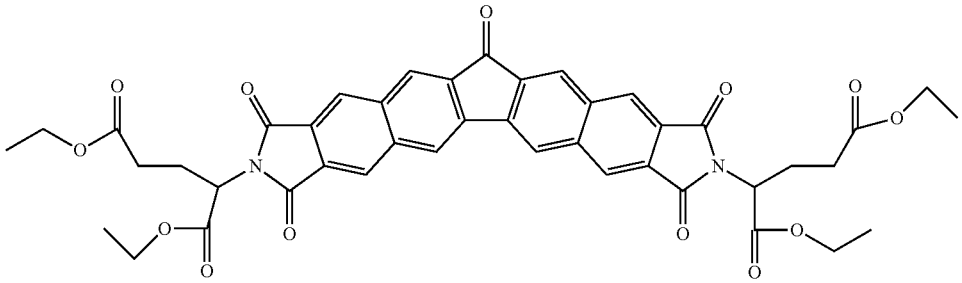

(1-4)

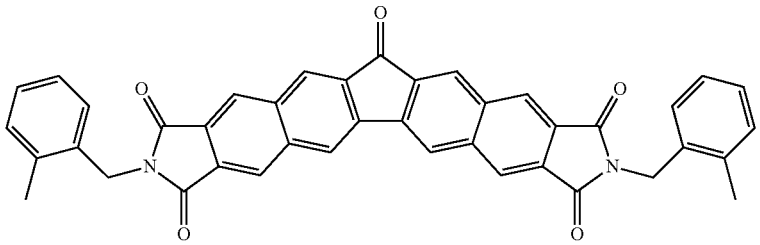

6. The electrophotographic photosensitive member according to claim 1, wherein the photosensitive layer is a single layer.

7. The electrophotographic photosensitive member according to claim 1, wherein the charge generating material includes an X-form metal-free phthalocyanine or a Y-form titanyl phthalocyanine.

8. The electrophotographic photosensitive member according to claim 1, wherein the photosensitive layer further contains a hole transport material, and the hole transport material includes a compound represented by a chemical formula (H-1) shown below:

(H-1)

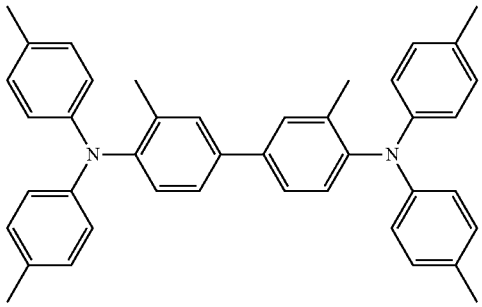

9. The electrophotographic photosensitive member according to claim 1, wherein the photosensitive layer further contains a binder resin, and the binder resin includes a polycarbonate resin including a repeating unit represented by a chemical formula (r-1) shown below:

(r-1)

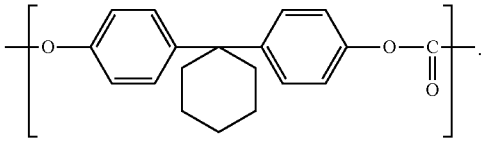

* * * * *